United States Patent [19]

Warfvinge

[11] Patent Number: 4,594,748

[45] Date of Patent: Jun. 17, 1986

[54] APPARATUS FOR CLEANING PARTICLES FROM A WEB

[75] Inventor: Kjell Warfvinge, Lund, Sweden

[73] Assignee: AB Kelva, Lund, Sweden

[21] Appl. No.: 447,831

[22] Filed: Dec. 8, 1982

[30] Foreign Application Priority Data

Dec. 9, 1981 [SE] Sweden ..... 8107374

[51] Int. Cl.[4] ..... A47L 5/14; A47L 5/38

[52] U.S. Cl. ..... 15/308; 15/345; 134/15; 134/21; 134/37

[58] Field of Search ..... 15/306 A, 345, 346, 15/347, 308; 134/15, 21, 32, 37; 162/279

[56] References Cited

U.S. PATENT DOCUMENTS

| | | | |
|---|---|---|---|
| 2,515,223 | 7/1950 | Hollick | 15/345 X |
| 2,818,595 | 1/1958 | Rosewall | 15/345 |
| 2,956,301 | 10/1960 | Bruno | 15/345 |
| 3,078,496 | 2/1963 | Doran et al. | 15/346 |
| 3,231,165 | 1/1966 | Wallin et al. | 15/345 X |
| 3,420,710 | 1/1969 | Wollman | 15/306 A |
| 3,436,265 | 4/1969 | Gardner | 134/21 |
| 3,668,008 | 6/1972 | Severynse | 15/306 A X |
| 3,775,806 | 12/1973 | Olbrant et al. | 15/306 A |

*Primary Examiner*—Arnold Turk
*Assistant Examiner*—Joye L. Woodard
*Attorney, Agent, or Firm*—Jones, Tullar & Cooper

[57] ABSTRACT

An apparatus for cleaning particles from a web is disclosed. An air flow is directed against the web through a pressure slit whereupon the air flow is deflected and guided along the web to two suction slits. The air flow is directed against the web by means of an nozzle in the shape of two expanding blades, which each are ended in an edge. Also the suction slits are surrounded by two blades and another two blades prevent the inlet of surrounding air. Each slit opens into a chamber, which each comprises an air distribution tube provided with rows of holes which are so adapted that the volume flow per length unit of the distribution tube of the slit will be essentially constant.

4 Claims, 3 Drawing Figures

APPARATUS FOR CLEANING PARTICLES FROM A WEB

FIELD OF THE INVENTION

The present invention relates to a method for cleaning a web from particles and a web cleaner for cleaning webs of e.g. paper, plastics, plastic paper or similar.

DESCRIPTION OF PRIOR ART

The problem of particles adhering to a web is known since a long time. Different methods of cleaning the web from such particles are also known.

There are two main types of web cleaners, viz. web cleaners which contact the web, such as brushes or wipers, and web cleaners of the non-contact type. The present invention relates to a web cleaner of the non-contact type.

In the lastmentioned type of web cleaners there are substantially three different approaches. One can observe that the particles adhering to the web are retained essentially by the influence of electrostatic attraction and/or due to a moisture meniscus which retain the particles. Finally, the particles can be more or less embedded in an adhesive layer on the surface.

In order to counteract the electrostatic attraction, the web is radiated with ions which can neutralize the electrostatic charges.

In order to counteract the moisture meniscus retaining the particles, a heated air flow is used, which wholly or partially evaporates the moisture layer.

In order to remove particles, which are partially embedded in the surface and are retained by adhesion, ultrasonic waves are used having wave lengths essentially corresponding to the size of the particles. Due to mechanical resonance the particles are vibrated and loosened from the web. The ultrasonic waves must be emitted within a great frequency range in order to be effective on particles of different sizes.

Finally, the loosened particles are transported away from the web by an air flow.

It is recognized that most of the problems of particles on webs, especially on plastic webs, can be solved with one or several of the abovementioned technics.

It is also recognized that loose fibres on e.g. a paper web can cause both hygienical and technical troubles. In some cases a careful and reliable cleaning of the web can be essential for the final product. A weld joint can be unreliable if too many particles are present.

Thus, there is a need for a simple but reliable web cleaner which can take care of loose particles on the web.

In the prior art it is established that the simple measure of directing an air flow against the web is usually not sufficient in order to clean the web. Further measures are necessary to make such an air flow efficient. This is due to the fact that the air adjacent the web surface forms a boundary layer having an air velocity which decreases close to the surface. This boundary layer often has a thickness of more that 100 $\mu$m. In the boundary layer, the air velocity is minimal. This means that also a powerful air flow cannot penetrate particles within the boundary layer, i.e. particles having a size of 100 $\mu$m or less. Other measures are needed, e.g. ultrasonic waves, in order to loosen the particles and bring them out of the boundary layer and into the air flow.

SUMMARY OF THE INVENTION

The object of the present invention is to provide a method of cleaning a web and a web cleaner, which are simple and yet reliable and are comparatively cheap, and are usable at very high web speeds from 300 m/min up to and exceeding 800 m/min, and which are independent of the web speed.

According to the invention an air jet is used to blow the particles from the web to a suction zone. The air jet is directed against the web, to be cleaned, through a slit, which is defined between two edges or doctor blades. The mouth of the slit is divergent in order to maintain the velocity of the air and the edges are positioned close to the web surface so that the air jet is forced to penetrate the boundary layer. The air jet is deflected by the web and the edges form turbulence in the air jet which further aids in penetrating the boundary layer.

BRIEF DESCRIPTION OF THE DRAWINGS

Further objects and features of the invention will become apparent from the following description of a preferred embodiment of the invention by reference to the drawings.

DESCRIPTION OF THE PREFERRED EMBODIMENT

Figure 1:
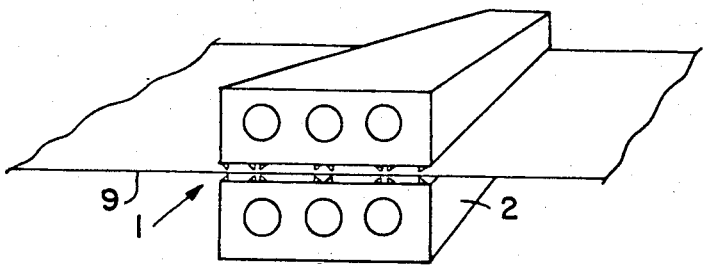
FIG. 1 is a perspective view of the web cleaner according to the invention.
Figure 2:
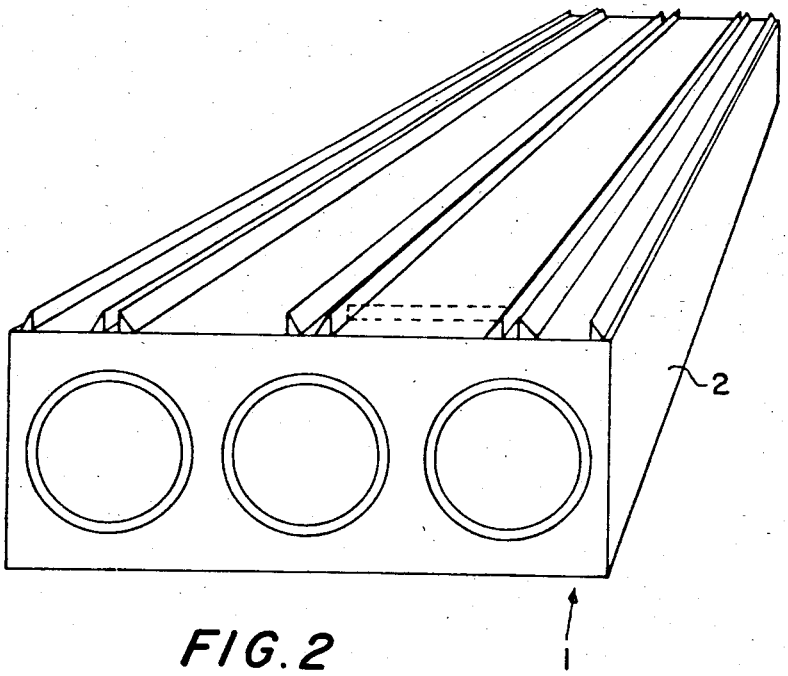
FIG. 2 is a more detailed perspective view of the web cleaner.

In FIGS. 1 and 2, the web cleaner according to the invention is shown in perspective view. The web cleaner 1 comprises a rectangular box 2 having a length corresponding to the width of the web. The box 2 is divided in three longitudinal inner chambers 3, 4 and 5, to which hoses are connected for feeding and discharging of air. Each chamber comprises a slit 6, 7, 8, which opens downwards against the web 9 to be cleaned.

Air is supplied to the middle chamber so that a positive pressure exists in relation to the surroundings, whereby the air flows out through the slit 7. On each side of the mouth of the slit, there are two edges or doctor blades 10, 11 having the shape appearing from FIG. 3. The blades extend essentially along the whole length of the slit 7. When the air flows through the slit 7, the sloping walls of the edges entail that the air flow expands, whereupon the air flow is deflected forwards and backwards after the air flow has reached the web. The direction of movement of the web 9 is from the right to the left in FIG. 2 as shown by the arrow 18, and thus forwards means to the left in FIG. 2.

Thereafter, the air flows against and along the web to the slits 8 and 6 and in through the slits to each inner chamber 5 and 3, where a negative pressure prevails. The slits 6 and 8 are also provided with blades 12, 13, 15, 16 of a shape similar to the blades 10, 11 of the slit 7. Furthermore similar blades 14, 17 are arranged close to the end walls of the box 2.

The web 9 passes immediately beyond the web cleaner 1 close to the doctor blades 10 to 17, the web being streched. The air jet from the slit 7 hits the web and loosen the particles, which are adhered to the web, whereupon the jet is deflected forwards and backwards. Since the air jet is at least partially turbulent, the air flow against the web 9 will be irregular having random alterations and rotations of the air mass, which contributes to the fact that such an air flow can at least partially penetrate the boundary layer, which normally prevails adjacent the web. This effect is increased by the fact that the blades 10, 11 nearly reach the web 9 and only small air cushions are formed between the blades 10, 11 and the web 9. Then the air flow is deflected backwards and forwards beyond the blades 10, 11, where the essentially vertical back walls of the blades will give rise to further swirls and complex air flows. Those swirls will shake the web and vibrate it, which entails that further loose particles are freed from the web.

Between the slit 7 and the slits 6 and 8, the air flows essentially parallel to the web to the blades 13 and 15 and where the air flow once again is pressed against the web before it is deflected upwards through the suction slits 6 and 8. Thus, the air flow transports the loosened particles away from the web and out through the suction slits. The air flow along this distance can be either laminar or partially turbulent. Since the character of the flow to a certain degree is dependent on the distance H between the web 9 and the wall 19 of the web cleaner, the flow will also depend on the height of the blades and how streched the web 9 is. If turbulent flow is required along this distance, there can be arranged flow obstacles, e.g. in the nature of wires, which are streched parallel to the blades.

Since a negative pressure exists in the slits 6 and 8, the air will flow from the surroundings and beyond the outer blades 14 and 17 and to the slits 6 and 8 and also follow the surface of the web. This air flow should be kept as small as possible, which can be made by letting the web 9 pass very close to the blades 14 and 17. Furthermore the shape of the blades having the vertical side facing inwards, contributes to decreasing the harmful flow, since a swirl and negative pressure are created immediately behind the edge, which breaks the air flow and also sucks the web 9 upwards against the blades 14 and 17. Since the blades comprises a comparatively sharp edge, this edge will also cut and loosen fibres, which extend beyond the surface of the web.

It is suitable for the air flow through the inner chambers 3 to 5 and the slits 6 to 8 to be balanced, so that the same air volume per time unit flows out through the slit 7 as flows in through the slits 6 and 8. Thus, the inner chambers 3 and 5 are connected to the suction side of the compressor or air pump (not shown), the pressure side of which is connected to the inner chamber 4. A filter for separating particles is of course arranged in connection with the compressor, which is previously known.

Moreover it is desirable that the air flow out through the slit 7 is essentially homogenous over the whole length of the slit and that the air flow between the pressure slit 7 and the suction slits 6 and 8 is essentially parallel to the movement direction 18 of the web.

According to the invention this is achieved by means of distribution tubes 20 to 22 arranged in the inner chambers 3 to 5. Each distribution tube extends along the whole length of the inner chamber, and is closed at its one end and connected to the connection hoses of the compressor at the other end. Each distribution tube comprises a number of holes 23 arranged along the periphery of the tube along the length of the tube. The distribution tubes 20 and 22 comprise two rows of holes positioned opposite to each other and opening towards the side wall of the inner chamber, i.e. perpendicular to the suction slit. The distribution tube in the pressure chamber 4 has three rows of holes positioned with 90° angles in relation to each other and opening away from the slit. The holes are positioned along the whole length of the tube. The holes are dimensioned so that the air flow out through the holes will be perpendicular to the axis of the tube, and thus has no flow component parallel to the axis of the tube. In order to achieve this goal, the holes can be equally spaced along the length of the tube but having decreased size along the length from the hose connection. Alternatively, the holes can have a larger spacing at the end of the tube. Since the pressure inside the tube is higher at the closed end of the tube, there is achieved a constant volume flow per centimeter of length of the tube, which entails a homogenous air flow through the pressure slit 7. The opposite is valid for the distribution tubes 20 and 22. Since it is not so important at the suction distribution tubes 20, 22, that the tubes do not have any longitudinal flow component, the holes of these distribution tubes can advantageously be made bigger and have greater spacings. On the distribution tube 20 of FIG. 3, there has been shown a second angular distribution of the rows of holes having a mutual angle of 120°, which also can be suitable. It is realized that more or fewer rows of holes can be adapted on the distribution tubes if required.

The desired flow pattern can be achieved in many other ways, e.g. by slits in the distribution tubes or by guiding plates instead of distribution tubes and so on.

It is also possible to arrange that the flow between the slits is essentially parallel to the movement direction of the web by arranging walls or guidings extending between the slits and parallel to the web movement which may be at a greater distance from the web compared with the blades. Such walls are most effective at the border of the web cleaner, compare FIG. 2.

Experiments have shown that the above described web cleaner is unexpectedly efficient, which is believed to depend on the fact that the blades 10 to 13, 15, 16 force the air to flow very close to the web and that the blades 14, 17 prevent the surrounding air from following the web into the system. The air flow out of the pressure slit 7 is expanded by the nozzle which is defined between the blades 10 and 11 and is forced very close to the web, which means that the pressure opposite the slit 7 is relatively low, while the pressure opposite the edges of the blades 10, 11 is greater. Thus, the web is vibrated by the air flows, which are turbulent which vibrations of course are small, so called micro vibrations and will have essentially the same operations as ultrasonic waves in previously known techniques.

Since those micro vibrations are generated by the turbulent air flow, they are constantly changing in intensity and direction in a random distribution, which entails that the micro vibrations vibrate the particles loose and loosens particles of different sizes at different occasions. Furthermore, the turbulent air flow can penetrate the boundary layer of the air close to the web and hit particles within this boundary layer and wash away those particles.

The object of the air flow is to generate very high local air flow velocities close to the surface of the web, in the vicinity of 10–30 m/s in order to affect free or partially embedded particles on the web. It is also desirable to have areas with high turbulence close to the web in order to lift the particles from the web in order to remove them by the air flow.

Since the essential air flow resistance occurs between the edges of the blades and the web, very high air flow velocities are provided. Furthermore, the edges generate whirlpool motion or turbulence immediately beyond the edge of each blade.

The air flow given off by the compressor has a higher temperature than the surrounding air depending on the adiabatic compression in the compressor. This is an advantage for the cleaning of the web, since some particles are embedded in a moisture meniscus. The hot air dries the web, whereby those particles are more easily loosened. The temperature of the air can be about 60°–70° C. It is also possible to use ionized air as is well known in order to reduce electrostatic charges.

The web cleaner can be arranged above and/or below the web, as indicated in FIG. 1. Preferably one web cleaner is placed above the web and one cleaner below the web but slightly offset in relation to the first web cleaner.

The doctor blades have essentially a right-angled triangular shape whereby the hypotenuse is always directed against the air flow in order to smoothly force the air flow against the web, whereupon the one small side generates a whirlpool. Of course the hypotenuse can be replaced by a curved surface, but we suppose that the edge at the border of the blade is essential for the efficiency. However, we will not exclude that a satisfactory operation can be achieved if the blades 10, 11 are replaced by a bead or a rib having a round shape and the same height.

Figure 3:
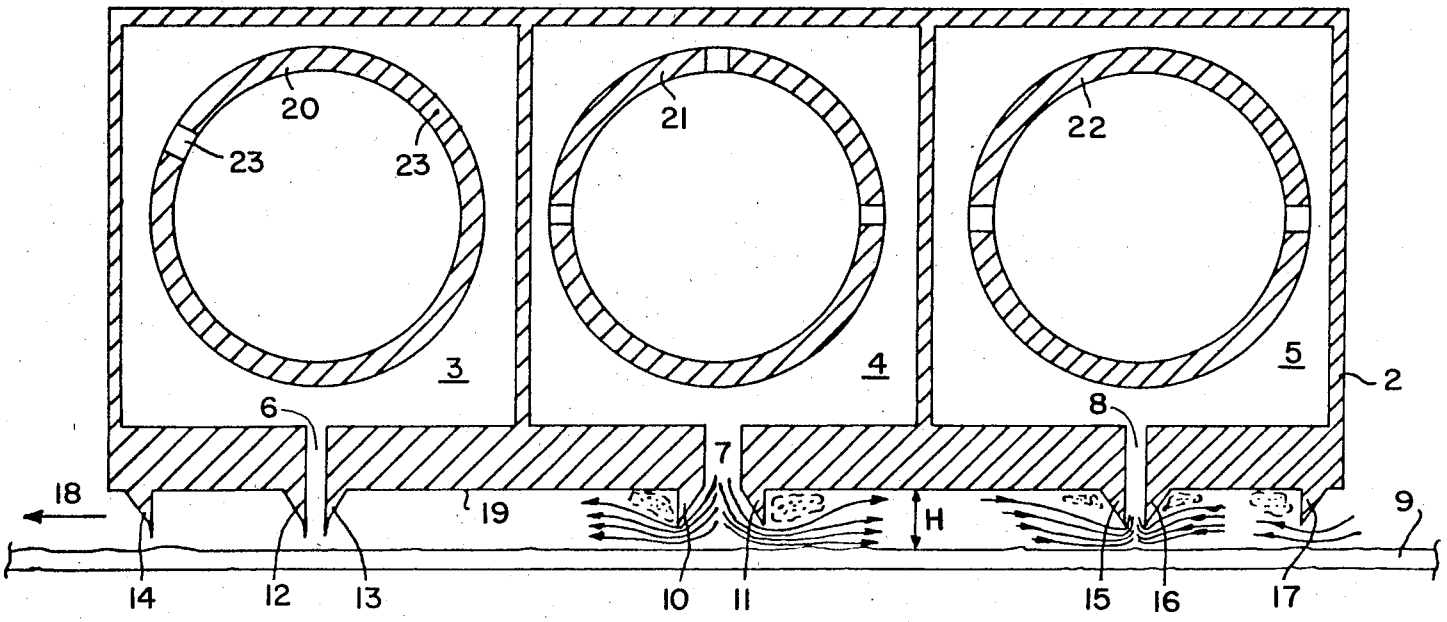
FIG. 3 is a cross sectional view of the web cleaner of FIG. 1.

FIG. 3 shows one pressure chamber and two suction chambers but it is also possible to use only one suction chamber. In this case it is suitable to incline the pressure slit in the direction against the suction slit, so that the air already has a certain flow component in the right flow direction when it hits the web.

It is also possible to supply the pressure air to and suck the return air from the chambers at both sides of the web cleaner. In this case there can be arranged hose connections at both sides of the web cleaner to the tubes 20, 21, 22. The holes of the tubes must be dimensioned in dependence of the new flow pattern. Alternatively, each chamber 3 to 5 can include two distribution tubes one from the right and one from the left, which also gives favourable flow distribution. Finally, experiments have shown that in certain cases it is possible to exclude the distribution tubes at air fed from both sides and in spite of this achieve a satisfactory air flow.

Finally, we will mention that the dimensions of the slits as appears from FIG. 3 also can be amended. In some cases it has been shown that it is advantageous with suction slits 6, 8 with greater size than the pressure slit 7.

The invention is not limited to the above described embodiment but can be amended in many ways within the scope of the appended claims.

I claim:

1. Apparatus for directing an air flow against the surface of a moving web, with sufficient velocity to penetrate a boundary layer adjacent the surface of the web and for creating sufficient turbulence in the air flow to produce microvibrations in the web for cleaning particles therefrom, comprising:

a box positioned adjacent the surface of a web to be cleaned, said box including at least first and second chambers extending across the width of the web to be cleaned and transversely to the direction of motion of the web to be cleaned, said first and second chambers including first and second walls, respectively, each wall facing and being generally parallel to the surface of the web to be cleaned;

first and second elongated slits extending along said first and second walls, respectively, said first and second slits each extending generally across the width of the web to be cleaned and being spaced apart in the direction of the motion of the web to be cleaned, said first and second slits having respective axes perpendicular to said first and second walls, respectively, and thus perpendicular to the surface of the web to be cleaned;

means to provide an elevated air pressure in said first chamber;

means to provide a negative air pressure in said second chamber;

first and second blades positioned on said first wall adjacent and on opposite sides of said first elongated slit and extending from said first wall toward the surface of the web to be cleaned, said first and second blades each being generally triangular in cross-section, each having a first surface inclined away from said axis of said first slit, and each having a second surface, said first and second surfaces of each of said first and second blades intersecting at corresponding first and second edges on opposite sides of said first slit and adjacent the web to be cleaned, said first and second blades cooperating to form a diverging nozzle for elevated pressure air in said first chamber, said first and second edges being located sufficiently close to the surface of the web to be cleaned that elevated pressure air passing through said diverging nozzle penetrates the boundary layer at the surface of the web and is deflected by the web to pass beyond said first and second blades to create turbulent air flow to produce micro-vibration of the web to be cleaned and to loosen particles at the surface of the web;

third and fourth blades positioned on said second wall adjacent and on opposite sides of said second elongated slit and extending from said second wall toward the surface of the web to be cleaned, said third and fourth blades each being generally triangular in cross-section, and each having a first surface generally parallel to said axis of said second slit and having a second surface inclined toward said axis of said second slit, said first and second surfaces of each of said third and fourth blades intersecting at corresponding third and fourth edges on opposite sides of said second slit and adjacent to the web to be cleaned, said third and fourth edges being located sufficiently close to the surface of said web to create turbulent air flow to further loosen particles at the surface of the web as the air from said first slit flows along the web to be cleaned and into said second slit.

2. The apparatus of claim 1, further including end blades positioned at first and second ends of said box, said end blades extending from said box toward the web to prevent surrounding air from flowing between said box and the web to said negative pressure second chamber.

3. The apparatus of claim 1, wherein said means to provide an elevated air pressure in said first chamber includes first distributing means for distributing said elevated pressure air equally along the entire length of said first slit and wherein said means to provide a negative air pressure in said second chamber includes second distributing means for distributing said negative pressure equally along the entire length of said second slit.

4. The apparatus of claim 3 wherein said first and second distributing means each includes a distribution tube positioned in its respective chamber, each said distribution tube having openings dimensioned to provide said elevated pressure air or said negative pressure air, respectively, equally along the entire lengths of the respective first and second slits in said first and second chambers.

* * * * *